US006786779B2

(12) United States Patent
Feldmeier et al.

(10) Patent No.: US 6,786,779 B2
(45) Date of Patent: Sep. 7, 2004

(54) ELECTRICAL PLUG CONNECTOR WITH SPRING TENSION CLAMP

(75) Inventors: Guenter Feldmeier, Lorsch (DE); Rudolf Kraemer, Lautertal (DE); Werner Tille, Stockstadt (DE); Karl-Heinz Hess, Heppenheim (DE); Markus Bollenbach, Darmstadt (DE); Christian Schrettlinger, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/463,269

(22) Filed: Jun. 17, 2003

(65) Prior Publication Data

US 2004/0043670 A1 Mar. 4, 2004

(30) Foreign Application Priority Data

Jun. 20, 2002 (EP) ..... 02013655

(51) Int. Cl.[7] ..... H01R 4/48
(52) U.S. Cl. ..... 439/729; 439/828; 439/835
(58) Field of Search ..... 439/729, 789, 439/826, 834–836, 441

(56) References Cited

U.S. PATENT DOCUMENTS 1,622,632 A * 3/1927 Fahnestock ..... 439/828
6,283,801 B1 * 9/2001 Guinda et al. ..... 439/835
6,336,824 B1 * 1/2002 Sorig ..... 439/441

FOREIGN PATENT DOCUMENTS

DE 19610958 C2 3/1996 ..... H01R/13/502

* cited by examiner

*Primary Examiner*—Hae Moon Hyeon
(74) *Attorney, Agent, or Firm*—Barley Snyder

(57) ABSTRACT

An electrical plug connector having a lower part and a cover which form a housing. At least one terminal point having a receiving pocket is formed within the lower part and the cover. A sub-assembly including a spring tension clamp having an arcuate tension spring, for making contact with electrical conductors, and a conductor rail having a contact region for receiving a mating contact is positioned in the receiving pocket. The cover has an actuator passageway and an angled guide projection extending into the actuator passageway for guiding an actuating tool to actuate the clamp. The angled guide projection is constructed as a web, the arcuate tension spring of the clamp has an aperture, and the angled guide projection reaches through the aperture as the cover is engaged with the lower part placed over the contact sub-assembly.

11 Claims, 4 Drawing Sheets

ELECTRICAL PLUG CONNECTOR WITH SPRING TENSION CLAMP

FIELD OF THE INVENTION

The invention relates to an electrical connector and more particularly to a plug connector having a two-part housing for receiving an electrical conductor upon activation of a clamp.

BACKGROUND

Known electrical connector plugs of this type typically include a lower part housing and a cover, having at least one terminal point. A receiving pocket is formed within the lower part and the cover. A sub-assembly includes a spring tension clamp having an arcuate tension spring, for making contact with electrical conductors, and a conductor rail having a contact region which may be brought into plug contact with a corresponding mating contact. The sub-assembly is received in the receiving pocket of the cover which has a plug-in opening. A guide slope is located inside the plug-in opening for receiving an actuating tool which actuates the spring tension clamp.

A plug connector of this kind is shown in DE 196 10 958 C2. The object there was to make it possible to fit components using simple linear insertion movements. For this purpose, the contact sub-assembly is introduced into the receiving pocket in the cover and then joined to the lower part. In certain situations, however, fitting the sub-assembly into the cover may make the assembly procedure and the corresponding tool complicated.

SUMMARY

An object of the invention is to further develop a plug connector of the type mentioned above such that it becomes possible to fit the sub-assembly into the lower part and cover using simple linear insertion movements.

This and other objects are achieved by an electrical plug connector having a lower part and a cover which form a housing. At least one terminal point having a receiving pocket is formed within the lower part and the cover. A sub-assembly including a spring tension clamp having an arcuate tension spring, for making contact with electrical conductors, and a conductor rail having a contact region for receiving a mating contact is positioned in the receiving pocket. The cover has an actuator passageway and an angled guide projection extending into the actuator passageway for guiding an actuating tool to actuate the clamp. The angled guide projection is constructed as a web, the arcuate tension spring of the clamp has an aperture, and the angled guide projection reaches through the aperture as the cover is engaged with the lower part placed over the contact sub-assembly.

BRIEF DESCRIPTION OF THE DRAWINGS

The invention will now be described by way of example with reference to the accompanying figures of which.

DETAILED DESCRIPTION OF THE PREFERRED EMBODIMENT

Figure 1:
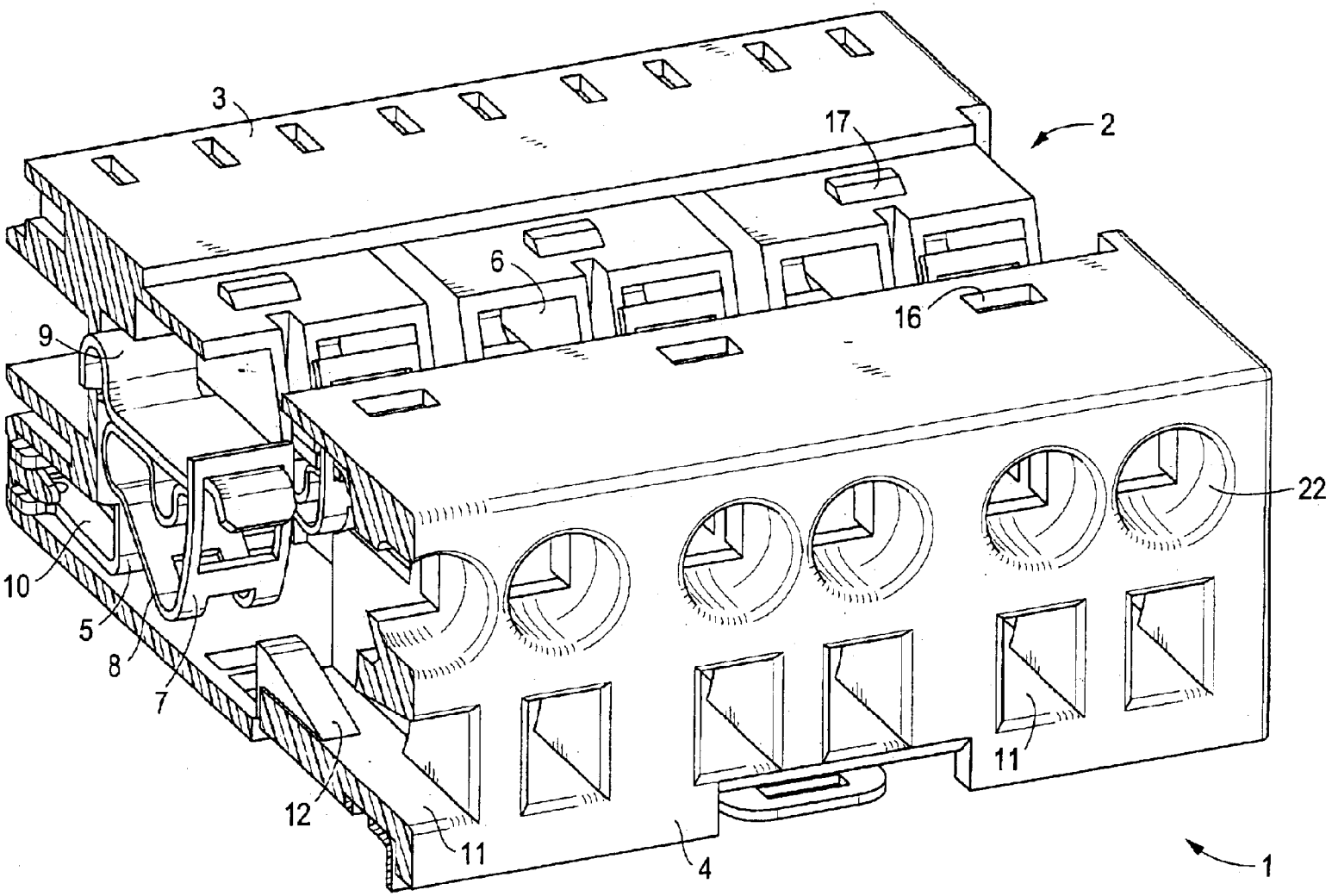
FIG. 1 is a perspective view of a partly cut-away housing with a contact introduced, with the cover not placed on the lower part.
Figure 2:
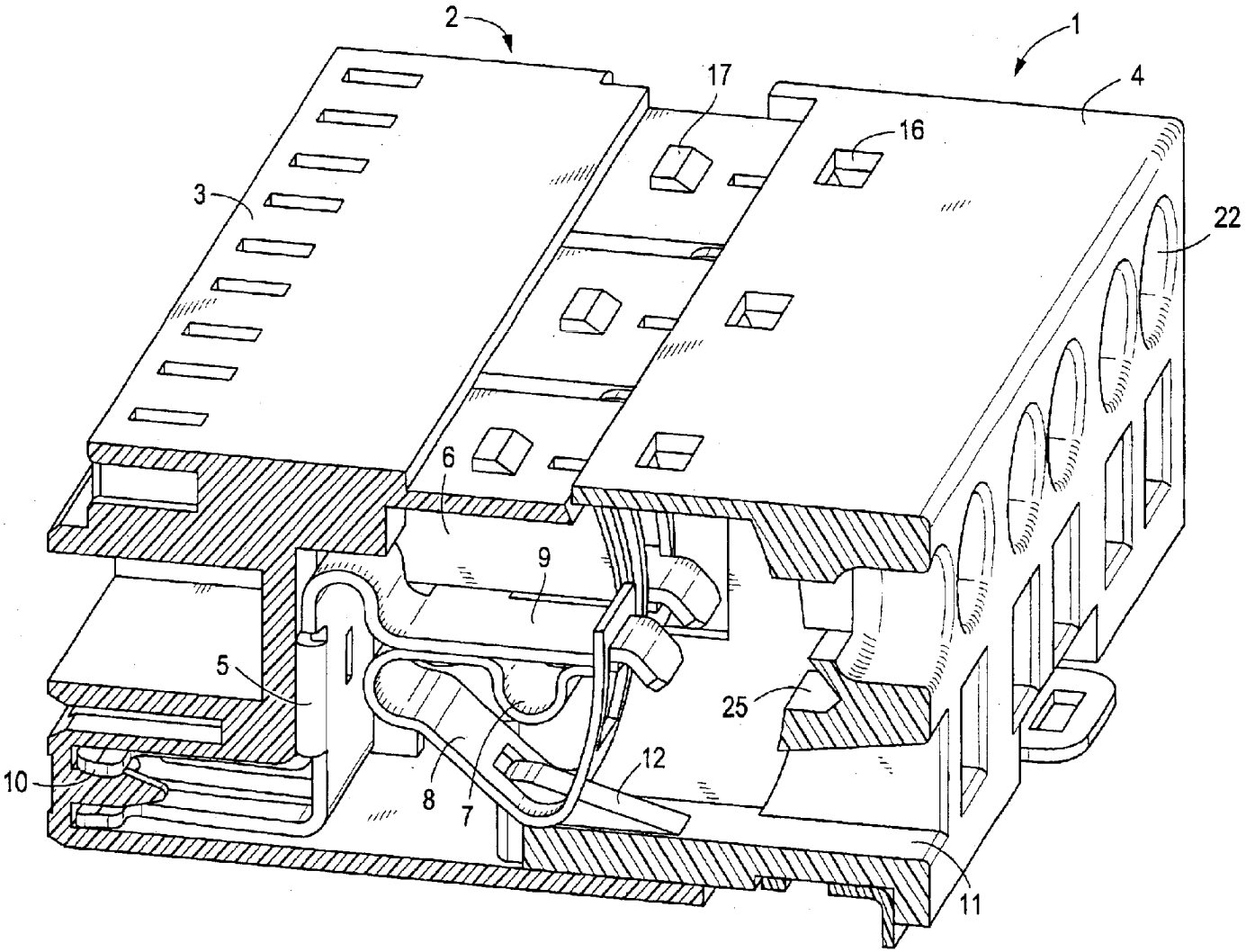
FIG. 2 is a perspective view of a partly cut-away housing with a contact introduced, with the cover not yet fully placed on the lower part.
Figure 3:
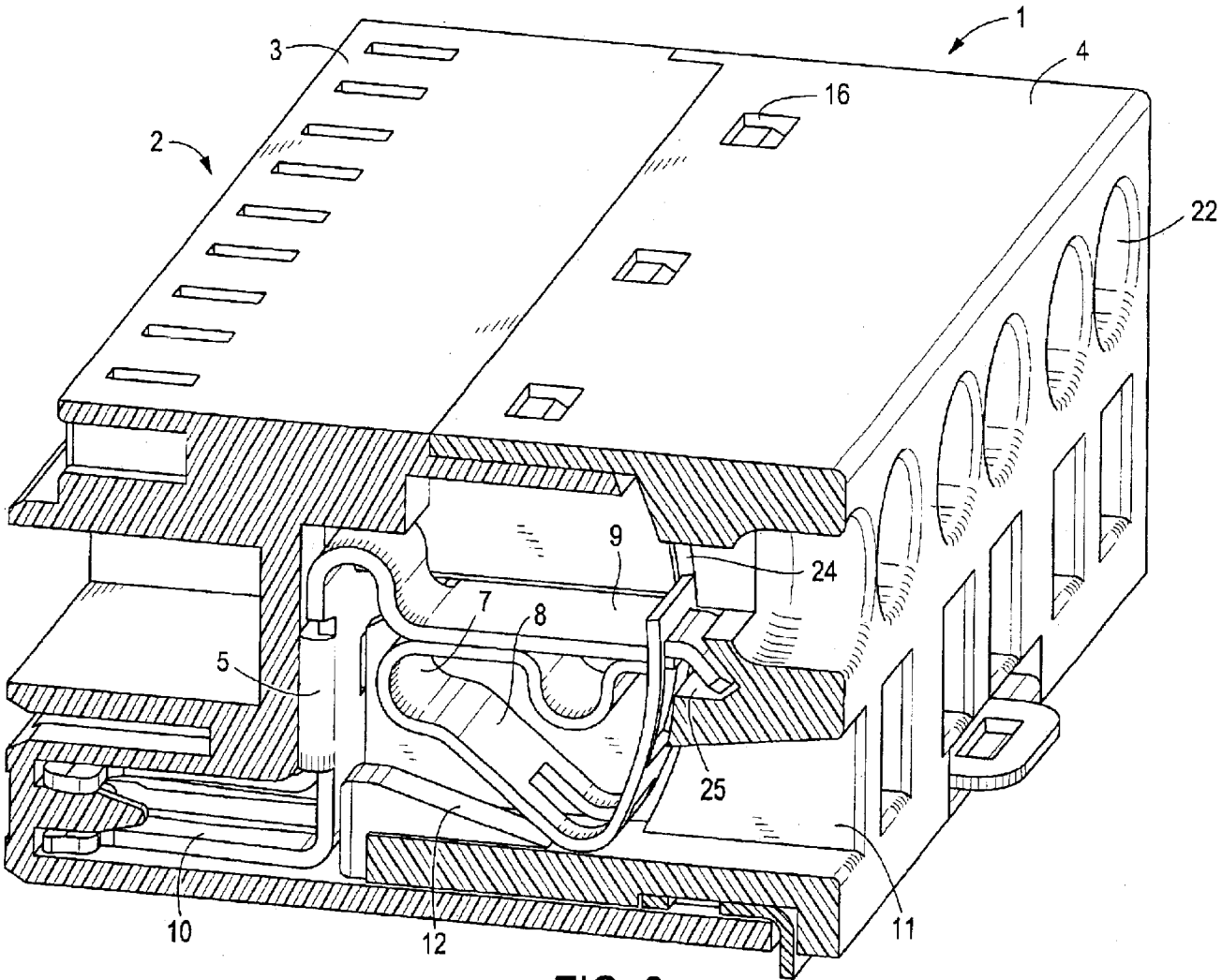
FIG. 3 is a perspective view of a partly cut-away housing with a contact introduced, with the cover fully placed on the lower part and latched thereto.

FIGS. 1–3 illustrate an electrical plug connector 1 in perspective view, in various stages of being put together. The connector has a two-part housing 2, comprising a lower part 3 and a cover 4, and a contact 5. In FIGS. 1–3, the contact 5 has already been introduced into the lower part 3, but the cover 4 is in different positions with respect to the lower part 3.

The plug connector illustrated has at least six (or more) terminal points with contacts 5. A terminal point comprises a receiving pocket 6, which is formed in the lower part 3 and the cover 4, and a contact 5 which in turn comprises a sub-assembly comprising a clamp 7 having an arcuate tension spring 8, for making contact with electrical conductors, and a conductor rail 9 having a contact region 10 which may be brought into plug contact with a corresponding mating contact (not shown).

The cover 4 has a actuator passageway 11 having an angled guide projection 12 for guiding an actuating tool to actuate the clamp 7. Furthermore, as best shown in FIG. 3, the cover 4 has a conductor receiving passageway 22 corresponding to each terminal point, for receiving a conductor.

The sub-assembly comprising a clamp 7 having an arcuate tension spring 8 and a conductor rail 9 may be introduced into the receiving pocket 6 in the lower part 3 in the mating direction. The cover 4 may then be placed over the lower part 3 and the two are engaged by sliding the cover 4 toward the lower part 3 along the mating direction.

Referring to FIG. 2, to make this type of engagement possible despite the angled guide projection 12, the angled guide projection 12 is constructed as a web, and the arcuate tension spring 8 of the clamp 7 has an aperture 13 so that the angled guide projection 12 passes through the aperture 13 when the cover 4 is placed on the contact sub-assembly 7 in the lower part 3. This particular construction makes it possible simply to put the parts together along the mating direction.

Figure 4:
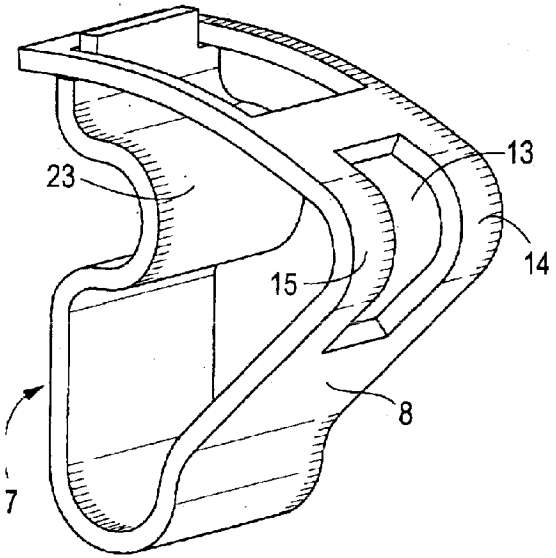
FIG. 4 is a perspective view of a spring tension clamp.

As best shown in FIG. 4, the aperture 13 extends in the longitudinal direction of the arcuate tension spring 8 and divides it into two tension spring webs 14, 15. This division makes it possible for the tension spring forces to be adjusted by selecting the length and width of the tension spring webs 14, 15.

The cover 4 and the lower part 3 have complementary latching members 16, 17 and latch into one another upon engagement as shown in FIGS. 1–3.

In the engagement position shown in FIG. 3, the contact 5 is fixed between the cover 4 and the lower part 3 in a recesses 25. The web having the angled guide projection 12 comes to lie above the contact region 10 and forms an contact stop when a contact 9 is inserted into the contact region 10. Guide grooves 24 are provided for slidingly receiving the clamp 7 after final assembly.

Figure 6:
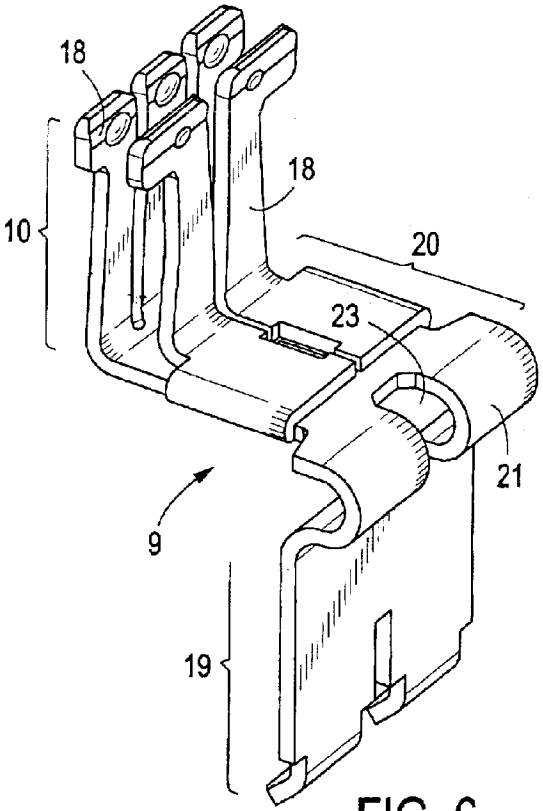
FIG. 6 is a further perspective view of a conductor rail with a contact region.
Figure 5:
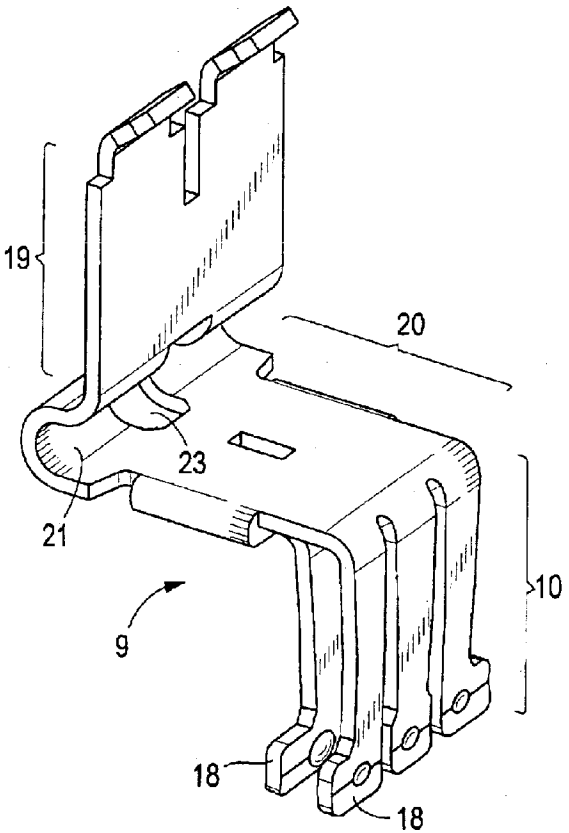
FIG. 5 is a perspective view of a conductor rail with a contact region.

The contact 5 is composed of the sub-assembly having the clamp 7 which includes the arcuate tension spring 8, for making contact with electrical conductors, and the conductor rail 9 having a contact region 10. The contact 5 is illustrated in FIGS. 4 to 6 in its individual constituent parts.

The contact 5 may be made by stamping and forming a conductive material such as a metal sheet. It does not need much space and has a high current carrying capacity, a low normal mating force and good spring properties.

The clamp 7 has an arc 23 opposite the arcuate tension spring 8. This arc 23 serves as a stop when the spring tension clamp is opened, and acts to counter any overstressing of the clamp 7.

The conductor rail 9 may be made by stamping and forming a piece of conductive material, such as a metal sheet. As a result of the particular construction, particularly good utilization of the stamped and formed material is ensured.

Referring to FIG. 5, the conductor rail 9 has three regions 10, 19, 20 which are at an angle with respect to one another, in particular in each case an angle of approximately 90°. The first region 19 comes to lie next to the clamp 7. The second region 20 is arranged approximately perpendicular to the mating direction and the third region 10 is formed by the contact region.

Located between the first and second regions 19, 20 is a U-shaped loop 21. This loop 21 makes possible a spring action in the mating direction and ensures that the regions 10 and 19 are mechanically uncoupled. An aperture 23 is provided for the purpose of adjusting the spring force of the loop 21.

Terminating a conductor in the plug connector 1 will now be described in greater detail. The clamp 8 is opened using an actuating tool (not shown) introduced through the actuator passageway 11. The actuate tension spring 8 slides within the guide grooves 24. The conductor can then be introduced through the conductor receiving passageway 22. The conductor then comes to lie between the conductor rail 9 and the clamp 7, which applies contact pressure as soon as the actuating tool is removed.

The contact region 10 is constructed as a receptacle contact. The receptacle contact has on two opposing sides an odd number of spring contact arms 18.

The spring contact arms 18 of the receptacle contact are angled with respect to a central region 20 of the conductor rail 9. In the central region 20, the material is arranged in two layers, at least in certain regions. The opposing spring contact arms 18 are each angled away from a respective layer of the material.

The particular construction of the angled guide projection and the arcuate tension spring is advantageous because it becomes possible to assemble the contact sub-assembly comprising the spring tension clamp having the arcuate tension spring and the conductor rail inside the lower part. It is furthermore particularly advantageous that this also gives rise to the additional possibility of adjusting the spring forces of the tension spring. The spring force of the tension spring can be adjusted through the width and length of the aperture. Moreover, the web serves as a stop for the contact region, which has proved particularly advantageous with high contact forces during mating.

Moreover, it is advantageous that as a result of interaction between the aperture, which extends in the longitudinal direction of the arcuate tension spring and divides it into two tension spring webs, and the web of the cover, it is ensured on assembly of the cover that the tension spring is correctly mounted in the receiving pocket.

It is moreover advantageous that the receiving pocket is constructed in the lower part such that the contact sub-assembly comprising the spring tension clamp having the arcuate tension spring and the conductor rail may be introduced into the receiving pocket in the lower part in the direction of plugging in. This further simplifies putting together the housing and the contact.

It is furthermore advantageous that the receiving pocket is constructed in the cover such that the cover may be placed on the contact sub-assembly in the lower part. Assembly is therefore particularly simple if both the contact and the cover can be assembled in one direction.

It is furthermore advantageous that the contact region of the spring tension clamp is constructed as a receptacle contact which has on two opposing sides an odd number of spring contact arms. This has the effect of optimum utilization of the stamped and formed conductive material.

It is furthermore advantageous that the conductor rail has three regions which are at an angle with respect to one another, in particular in each case an angle of approximately 90°. This has the effect that despite the short overall construction and hence the small overall volume, good spring properties are achieved.

We claim:

1. An electrical plug connector comprising:

a housing having a lower part and a cover;

at least one terminal point having a receiving pocket formed within the lower part and the cover, the cover having an actuator passageway and an angled guide projection being constructed as a web and extending into the actuator passageway for guiding an actuating tool; and, a sub-assembly being positioned in the receiving pocket and including a spring tension clamp having an arcuate tension spring for making contact with electrical conductors, an aperture being formed in the arcuate tension spring and a conductor rail having a contact region for receiving a mating contact;

whereby the angled guide projection extends through the aperture as the cover is engaged with the lower part placed over the sub-assembly.

2. A plug connector according to claim 1, wherein the aperture extends in the longitudinal direction of the arcuate tension spring and divides it into two tension spring webs.

3. A plug connector according to claim 1, wherein the receiving pocket is formed in the lower part such that the sub-assembly may be introduced in a mating direction into the receiving pocket of the lower part.

4. A plug connector according to claim 3, wherein the receiving pocket is formed in the cover such that the cover may be placed on the sub-assembly over the lower part.

5. A plug connector according to claim 1, wherein the cover and the lower part have complementary latching members and latch into one another when engaged with each other.

6. A plug connector according to claim 1, wherein the contact region of the conductor rail is formed as a receptacle contact.

7. A plug connector according to claim 6, wherein the receptacle contact has two opposing sides and an odd number of spring contact arms.

8. A plug connector according to claim 1, wherein the conductor rail has three regions which are at approximately at a right angle with respect to one another.

9. A plug connector according to claim 1, wherein the conductor rail is made by being stamped and formed from a piece of sheet metal.

10. A plug connector according to claim 7, wherein the spring contact arms of the receptacle contact are angled with respect to a central region of the conductor rail in which the sheet metal is arranged in two layers, at least in certain regions.

11. A plug connector according to claim 10, wherein the opposing spring contact arms are each angled away from a respective layer of the sheet metal.

* * * * *